United States Patent [19]

Suckno

[11] 4,272,061

[45] Jun. 9, 1981

[54] VARIABLE PITCH RAIL SYSTEM

[75] Inventor: Howard Suckno, Livingston, N.J.

[73] Assignee: Suckno Brothers Company, South Plainfield, N.J.

[21] Appl. No.: 97,903

[22] Filed: Nov. 28, 1979

[51] Int. Cl.[3] ..... E04H 17/00

[52] U.S. Cl. ..... 256/67; 256/22

[58] Field of Search ..... 256/65, 67, 22

[56] References Cited

U.S. PATENT DOCUMENTS

| | | | |
|---|---|---|---|
| 1,416,957 | 5/1922 | Hughes | 256/22 |
| 1,526,638 | 2/1925 | Knight | 256/22 |
| 2,754,092 | 7/1956 | Cremens | 256/65X |
| 3,306,586 | 2/1967 | Green | 256/22 X |
| 4,138,094 | 2/1979 | Thir | 256/67 |

*Primary Examiner*—Andrew V. Kundrat

*Attorney, Agent, or Firm*—Harvey B. Jacobson

[57] ABSTRACT

The system comprises a hand rail and shoe rail having channels running longitudinally therein. A plurality of balusters are connected between the hand rail and shoe rail by means of pivot pins extending through the walls of the channel and a hole formed in each baluster. In this manner, the pitch of the baluster with respect to the hand rail and the shoe rail can be changed to accommodate the pitch of the staircase upon which the system is to be used. Once installed, the channel areas between adjacent balusters are filled and the hand rail and shoe rail is attached to a newel post.

1 Claim, 9 Drawing Figures

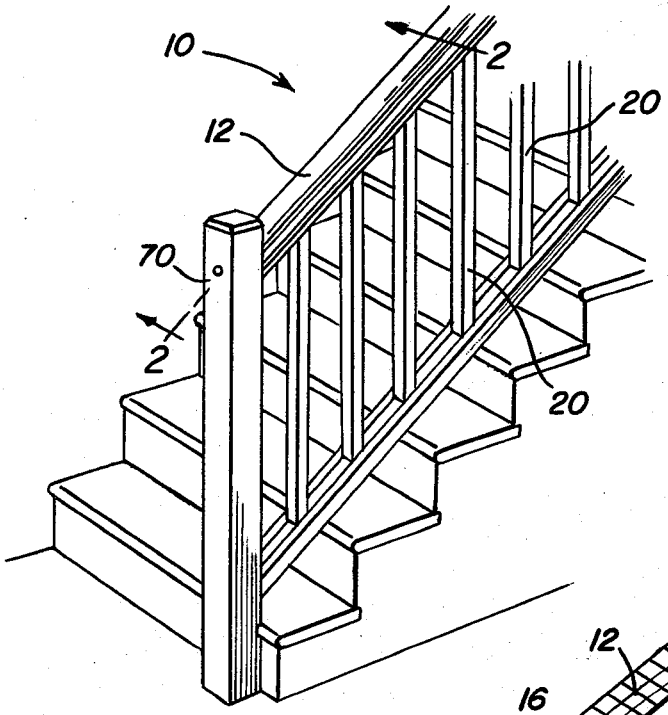
Fig. 1
Fig. 2
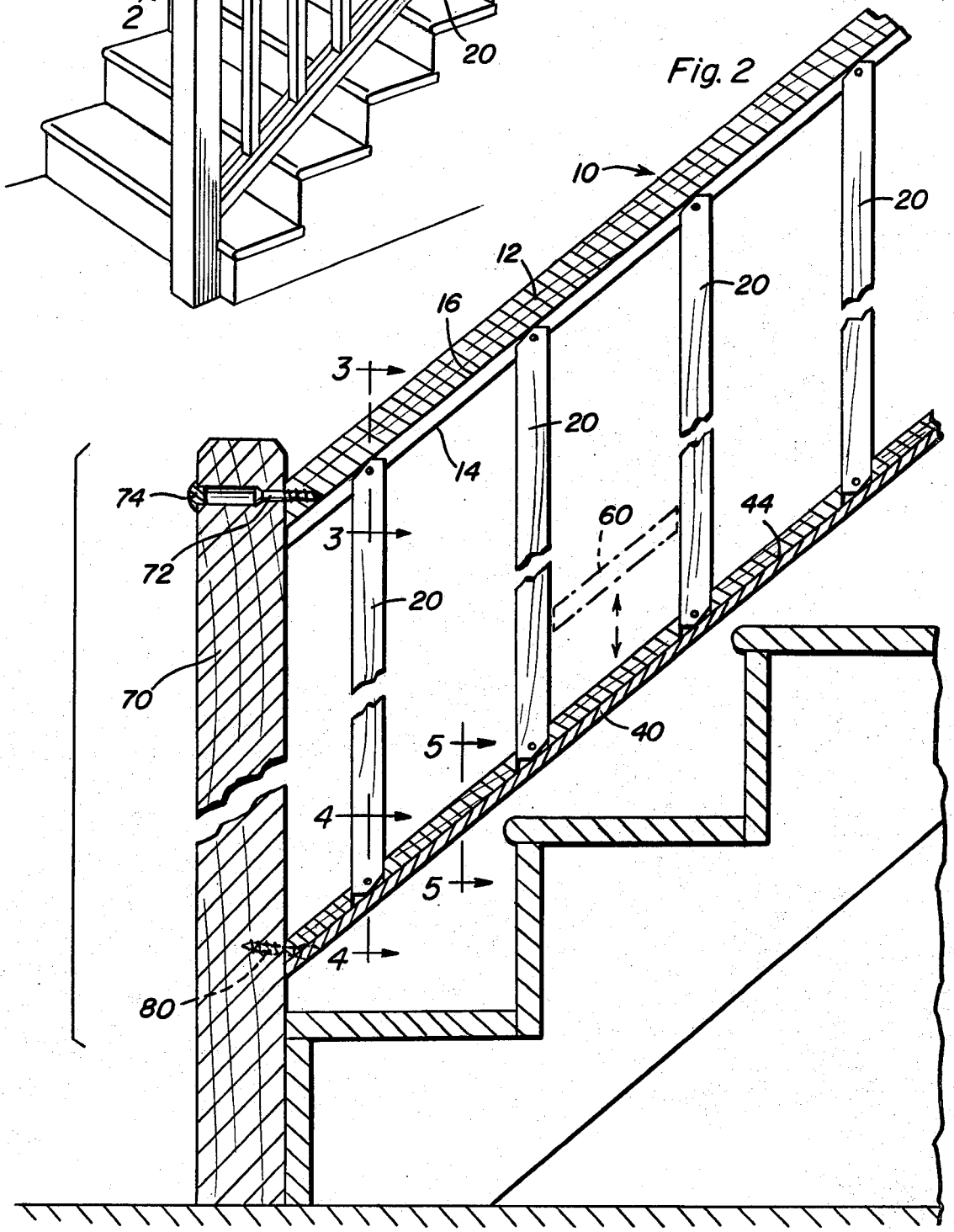

VARIABLE PITCH RAIL SYSTEM

BACKGROUND OF THE INVENTION

1. Field of the Invention

This invention relates to prefabricated railing systems adapted for use on staircases having virtually any pitch angle.

2. Discussion of the Related Art

Each staircase has a pitch angle of its own. This angle is determined by the rise (height of the top of one stair tread to the top of the next stair tread) and the run (depth of the stair tread from the face of one rise to the face of the next rise). There are incalculable numbers of combinations which result in many pitch angles. Prefabricated railings have been produced for many years, but with a major drawback. They must be cut to the precise angle of the stair for which they are intended. If for any reason the stair is not installed perfectly level, the angle is wrong. The result is that the railing follows either a greater or lesser angle than the stair or that the railing must be installed so that the newel post and/or balusters are not placed perfectly vertical.

Various hand rail systems have been suggested. For instance, U.S. Pat. No. 2,870,996, issued Jan. 27, 1959, to Helt, shows a system having a plurality of vertically extending tubular spindles provided in spaced, parallel relationship. The top ends of the spindles are pivotally connected to a top rail and the bottom ends are pivotally connected to a bottom rail. U.S. Pat. No. 3,804,374, issued Apr. 16, 1974, to Thom, shows a twin post railing system having pairs of laterally spaced post members. Each pair of posts has a vertically adjustable clamp mechanism extending laterally therebetween. Both the posts and the clamp mechanisms are cut from extruded metal pieces for inexpensive manufacture. An offset hand rail is angularly adjustably mounted upon one of the clamp mechanisms of each pair of posts. U.S. Pat. No. 3,414,236, issued Dec. 3, 1968, to Siegal, shows a foldable hand rail in the form of a downwardly opening channel having side walls diverging at their ends, the inside of which form wedging surfaces. The diverging side walls engage outwardly extending feet of an inner channel, pivoted to the pickets of the hand rail.

SUMMARY OF THE INVENTION

One object of the present invention is to provide a prefabricated railing system having a variable pitch angle which adjusts automatically to any stair.

A further object of the present invention is to provide a variable pitch railing system having balusters connected between channels formed in a hand rail and a shoe rail with the baluster fitting snugly in the channels to provide a secure and solid connection.

Yet a still further object of the present invention is to provide a variable pitch hand rail system having fillet pieces attachable in the channels after the hand rail is set in position in order to more securely hold the system in position and provide aesthetic appeal.

Another object of the present invention is to provide a variable pitch hand rail system which can be connected to any newel post after the pitch angle of the system is established.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of a railing system according to the present invention in place on a staircase.

FIG. 2 is an elevational sectional view taken substantially along a plane passing through section line 2—2 of FIG. 1.

DESCRIPTION OF THE PREFERRED EMBODIMENT

Figure 3:
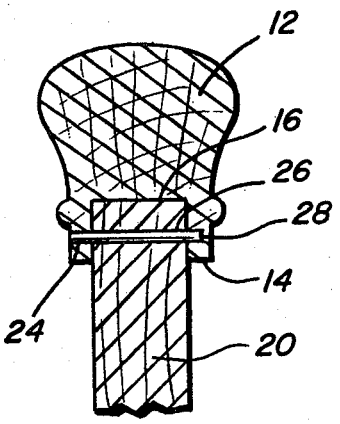
FIG. 3 is an end elevational sectional view taken substantially along a plane passing through section line 3—3 of FIG. 2.
Figure 8:
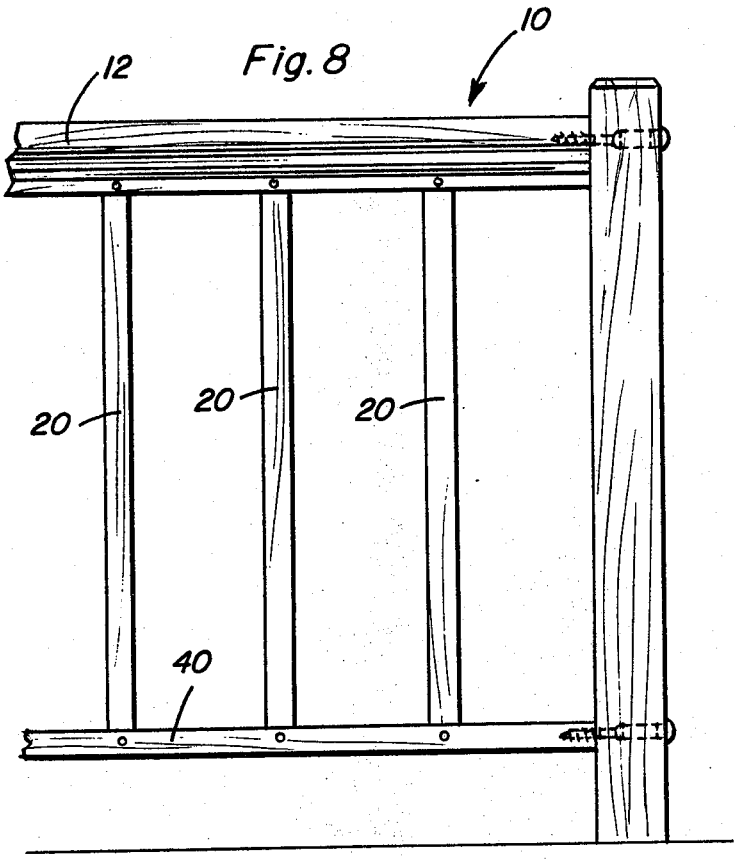
FIG. 8 is a side elevational view of the variable pitch rail system disposed in a horizontal mode.
Figure 4:
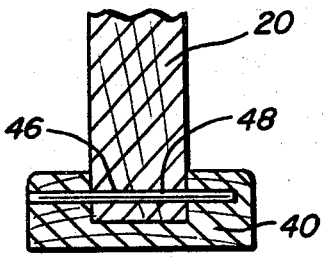
FIG. 4 is an end elevational sectional view taken substantially along a plane passing through section line 4—4 of FIG. 2.

Now with reference to the drawings, a variable pitch rail system incorporating the principles and concepts of the present invention and generally referred to by the reference numeral 10 will be described in detail. The railing system is preferably formed from wood and comprises a hand rail 12 having any desired shape. The hand rail 12 includes a bottom surface 14 having a rabbet or channel 16 formed therein. Rabbet 16 is preferably ½ inch deep and 1⅛ inches in width. The rabbet extends longitudinally of the hand rail 12 for the entire length of the hand rail to receive the tops of balusters 20. Each baluster has a width which is approximately equal to the width of the rabbet 16 and thus fits snugly thereinto. Each baluster 20 is held within the rabbet 16 by use of pivot pin 22 which is inserted through an opening 24 in one wall of the rabbet 16, through aperture 26 formed in the top of the hand rail and into a socket 28 in the opposite wall of the rabbet 16 thus producing a pivotal connection between the hand rail and baluster 20. The top of each baluster 20 has two flat sections one of which generally labelled 30 is perpendicular to the length of the baluster, while the other, labelled 32, is at a 45° angle with section 30. Accordingly, each baluster can pivot from an angle at which it is substantially perpendicular to the hand rail 12 to an angle of approximately 45° with respect to the hand rail.

In a similar manner, a shoe rail 40 has an upper surface 42 with a shoe rail rabbet 44 formed therein extending for the entire length of the shoe rail 40. Shoe rail 40 is preferably ¾ inch deep with the rabbet 44 being ½ inch deep and 1⅛ inches in width to receive the lower end of balusters 20. The lower end of each baluster 20 also contains an aperture 46 through which pivot pin 48 passes for holding the baluster in the shoe rail rabbet 44. Pin 48 passes through opening 50 in one wall of the rabbet 44 and into a socket 52 in the opposite wall. The lower end of each baluster 20 also contains two surfaces 54 and 56 which are formed at 45° to each other and in opposed relation to surfaces 30 and 32, respectively, so that the hand rail 12 and the shoe rail 40 can be held parallel to each other and displaced so as to change the angular relationship between those elements and the baluster from a perpendicular relationship to a 45° angle.

Figure 5:
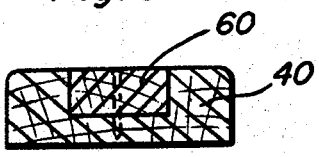
FIG. 5 is an end elevational sectional view taken substantially along a plane passing through section line 5—5 of FIG. 2.
Figure 6:
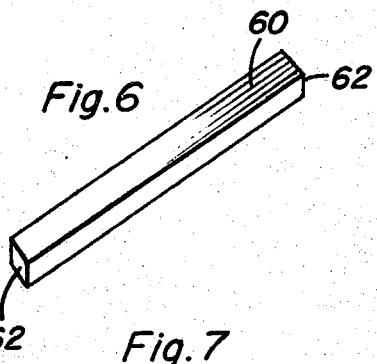
FIG. 6 is a perspective view of one section of fillet.

Sections of fillet 60, shown most clearly in FIGS. 5 and 6 have end surfaces 62 which are cut at the appropriate angle to fit between balusters 20 after the balusters are set in place. The fillet 60 can be nailed, screwed or glued in place to provide rigidity to the entire system. The fillet can be inserted in the shoe rabbet 44 as shown in FIG. 2 and also can be inserted between the balusters 20 in the rabbet 16 formed in hand rail 12. The fillet serves not only to provide structural rigidity to the system but also to enhance the aesthetic appeal of the hand rail by covering the areas of the baluster 20 where they are not flush with the base of the associated rabbets. Each section of fillet 60 is preferably ½ inch deep and 1⅛ inches in width in order to substantially fill the portion of the associated rabbet and to be flush with the surface of the shoe rail or hand rail in which the rabbet is formed.

Figure 7:
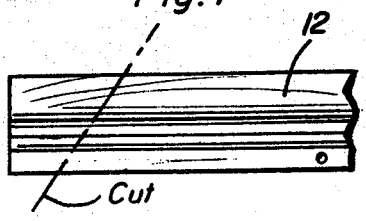
FIG. 7 is a diagrammatical view showing a hand rail being cut for attachment to a newel post.
Figure 9:
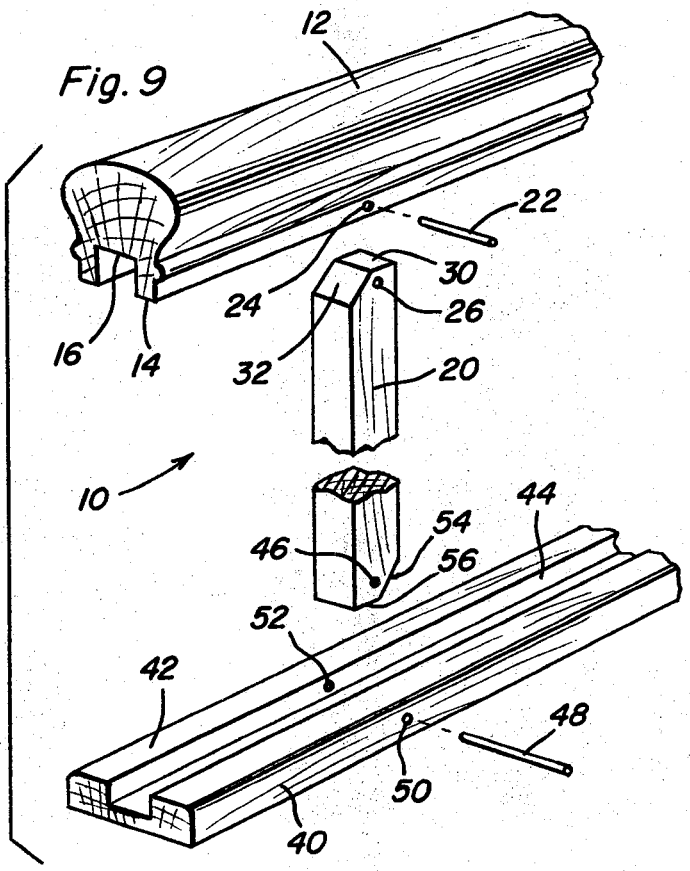
FIG. 9 is an exploded view of the variable pitch rail system.

The system is provided with one top rail 20, one base rail 40 and a plurality of balusters 20 pivotally interconnected therebetween. The ends of the hand rail and the base rail are perpendicular as shown in FIG. 7 and can be cut at the appropriate angle as shown in dotted line in FIG. 7 for connection with any desired newel post 70 as shown in FIGS. 1 and 2. The upper ends of the hand rail 12 and shoe rail 40 are cut in a similar manner for connection to an upper newel post or wall as desired. Once the appropriate cut is made in the hand rail or shoe rail, the rail system 10 is attached to the newel post 70 by standard means including a screw 72 extending through the newel post 70 and into the hand rail 12. A cap 74 is disposed over the opening through which screw 72 is inserted. A second screw 80 extends through the shoe rail 40 and into the newel post 70.

As a part of the railing system there is also provided prefabricated rigid railing sections for areas where level railings are used. These are areas such as balconies or platforms and constitute the only areas wherein rigid railings can be utilized efficaciously.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A variable pitch railing system comprising:

a hand rail having a lower surface, said lower surface having a longitudinally extending, downwardly opening channel formed therein, said downwardly opening channel being formed with first and second side walls, said first side wall having apertures directed therethrough for receiving first pivot pins, said second side wall having sockets formed therein, said second side wall sockets extending only partially through said second side wall, said first side wall apertures and said second side wall sockets being respectively axially aligned whereby one of said first pivot pins may be inserted through one first side wall aperture and into engagement with one second side wall socket;

a shoe rail having an upper surface disposed in a facing opposed relation to said lower surface of said hand rail, said upper surface having a longitudinally extending, upwardly opening channel formed therein, said upwardly opening channel being formed with third and fourth side walls, said third side wall having apertures directed therethrough for receiving second pivot pins, said fourth side wall having sockets formed therein, said fourth side wall sockets extending only partially through said fourth side wall, said third side wall apertures and said fourth side wall sockets being respectively axially aligned whereby one of said second pivot pins may be inserted through one third side wall aperture and into engagement with one fourth side wall socket;

a plurality of balusters extending between said hand rail and said shoe rail, said balusters having first and second ends with apertures formed therein and extending therethrough, said first and second ends being positionable within said downwardly opening channel and said upwardly opening channel and said first and second pivot pins being positionable through the apertures in said first and second ends so as to effectively secure said balusters to said hand rail and said shoe rail, said first and second ends of said balusters further including first and second oblique, flat chamfered surfaces cut relative thereto so as to permit a variable pitch pivotal movement of said balusters about said first and second pivot pins, said first and second chamfered surfaces being on opposite sides of said balusters and lying in a spaced apart parallel planar relationship with the chamfered surfaces limiting the pivotal movement between the rails and balusters and the outer ends of the chamfered surfaces being located between the walls of the channels in all angular positions of the balusters and rails; and at least one fillet having a length approximately equal to a distance between adjacent balusters, said at least one fillet being dimensioned with a cross section approximately equal to that of said upwardly opening channel for substantially filling the space in said channel between adjacent balusters.

* * * * *